US006663521B2

(12) United States Patent
Uryu et al.

(10) Patent No.: US 6,663,521 B2
(45) Date of Patent: Dec. 16, 2003

(54) POWER TRANSMITTING MECHANISM

(75) Inventors: Akifumi Uryu, Kariya (JP); Kazuya Kimura, Kariya (JP); Takeshi Kawata, Kariya (JP); Akinobu Kanai, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/927,658

(22) Filed: Aug. 10, 2001

(65) Prior Publication Data

US 2002/0086750 A1 Jul. 4, 2002

(30) Foreign Application Priority Data

Aug. 11, 2000 (JP) ..... 2000-245370

(51) Int. Cl.[7] ..... F16H 63/00; F04B 49/00; F04B 35/02

(52) U.S. Cl. ..... 474/70; 474/199; 474/903; 417/223; 417/229

(58) Field of Search ..... 474/93, 199, 70, 474/903, 74; 464/30, 77, 160; 417/223, 269, 362, 16, 373; 192/223, 71, 55.1, 56.1; 92/57, 12.2

(56) References Cited

U.S. PATENT DOCUMENTS

| | | | | | |
|---|---|---|---|---|---|
| 4,287,974 | A | | 9/1981 | Krejci | 192/56 |
| 6,077,048 | A | * | 6/2000 | Okada et al. | 417/223 |
| 6,112,639 | A | * | 9/2000 | Kimura et al. | 417/269 |
| 6,152,845 | A | | 11/2000 | Okada et al. | 474/93 |
| 6,164,929 | A | * | 12/2000 | Kazuya et al. | 417/362 |
| 6,213,882 | B1 | * | 4/2001 | Okada et al. | 464/77 |
| 6,234,904 | B1 | | 5/2001 | Kawaguchi et al. | 464/30 |
| 6,247,899 | B1 | * | 6/2001 | Ban et al. | 417/16 |
| 6,283,722 | B1 | * | 9/2001 | Takenaka et al. | 417/222.2 |

FOREIGN PATENT DOCUMENTS

| | | | | |
|---|---|---|---|---|
| DE | 100 01 258 A1 | | 8/2000 | F16D/7/04 |
| EP | 0 890 760 A2 | | 1/1999 | F16H/35/10 |
| JP | 10-47244 | * | 2/1998 | |
| JP | 10-267048 | | 10/1998 | F16D/7/04 |
| JP | 10-292958 A | * | 11/1998 | |
| JP | 2000-179569 | | 6/2000 | F16D/11/04 |
| RU | 804922 | | 2/1981 | F16D/7/00 |

* cited by examiner

*Primary Examiner*—Marcus Charles
(74) *Attorney, Agent, or Firm*—Morgan & Finnegan, LLP

(57) ABSTRACT

A power transmitting mechanism transmits power from an engine to a drive shaft of a compressor. A pulley is supported by the compressor and is coupled to the engine. A hub is attached to the drive shaft. Rollers are located on the pulley. Elastic transmission arms are located between the pulley and the hub. The distal end of each arm is curved, and the proximal end is coupled to the hub. When the rollers are engaged with the arms, power is transmitted between the pulley and the hub. When, due to excessive torque, the rollers escape from the corresponding arm, power transmission between the pulley and the hub is disconnected. The distal ends of the arms are movable in the radial direction. When the rollers disengage from the corresponding arms, the distal ends of the arms move radially such that the pulley and the hub relatively rotate without interference by the arms.

23 Claims, 5 Drawing Sheets

POWER TRANSMITTING MECHANISM

BACKGROUND OF THE INVENTION (A) Field of the Invention

The present invention relates to a power transmitting mechanism that disconnects power transmission from a first rotor to a second rotor when an excessive torque (load) is transmitted between the first rotor and the second rotor.

(B) Description of the Related Art

Japanese Unexamined Patent Publication No. 11-30244 discloses such a power transmitting mechanism, which has a rotor driven by an external drive source and a rotor for a device. The rotors are coupled to each other by a rubber part for transmitting power. When the transmission torque from the external drive source to the device is excessive due to a malfunction of the device, or when the device is locked, the rubber part breaks. Thus, power transmission from one of the rotors to the other is disconnected. Accordingly, the mechanism prevents the external drive source from being affected by an excessive transmission torque.

According to the above prior art, even though the rubber part broken out due to the excessive torque, the external drive source and the device are partially engaged by friction at the location of the rubber part. Thus, power transmission between the rotors is not completely disconnected. This results in poor fuel economy when, for example, the external drive source is an engine of a vehicle and the device is a vehicle auxiliary device.

SUMMARY OF THE INVENTION

Accordingly, it is an objective of the present invention to provide a power transmitting mechanism that reliably disconnects power transmission between a first rotor and a second rotor when the transmission torque between the rotors is excessive.

To achieve the foregoing objective, the present invention provides a power transmitting mechanism comprising a first rotor, a second rotor, and a coupler. The second rotor is coaxial to the first rotor and is driven by the first rotor. The coupler connects the first rotor to the second rotor such that the coupler uncouples when the torque transmitted by the coupler exceeds a predetermined value. The coupler includes a first coupling member and a second coupling member. The first coupling member is formed on the first rotor. The second coupling member is formed on the second rotor. One of the coupling members includes an arm. A distal end of the arm engages the other of the coupling members. The arm is disengaged from the other of the coupling members. The distal end moves in a generally radial direction of the rotors to a non-interfering position when the coupler uncouples.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A power transmitting mechanism according to a first embodiment of the present invention will now be described. This embodiment relates to an air-conditioning system for a vehicle. A variable displacement swash plate type compressor is a driven auxiliary device and an engine is used as an external drive source. The power transmitting mechanism is in the power transmission path between the engine and the compressor.

Variable Displacement Swash Plate Type Compressor

Figure 1:
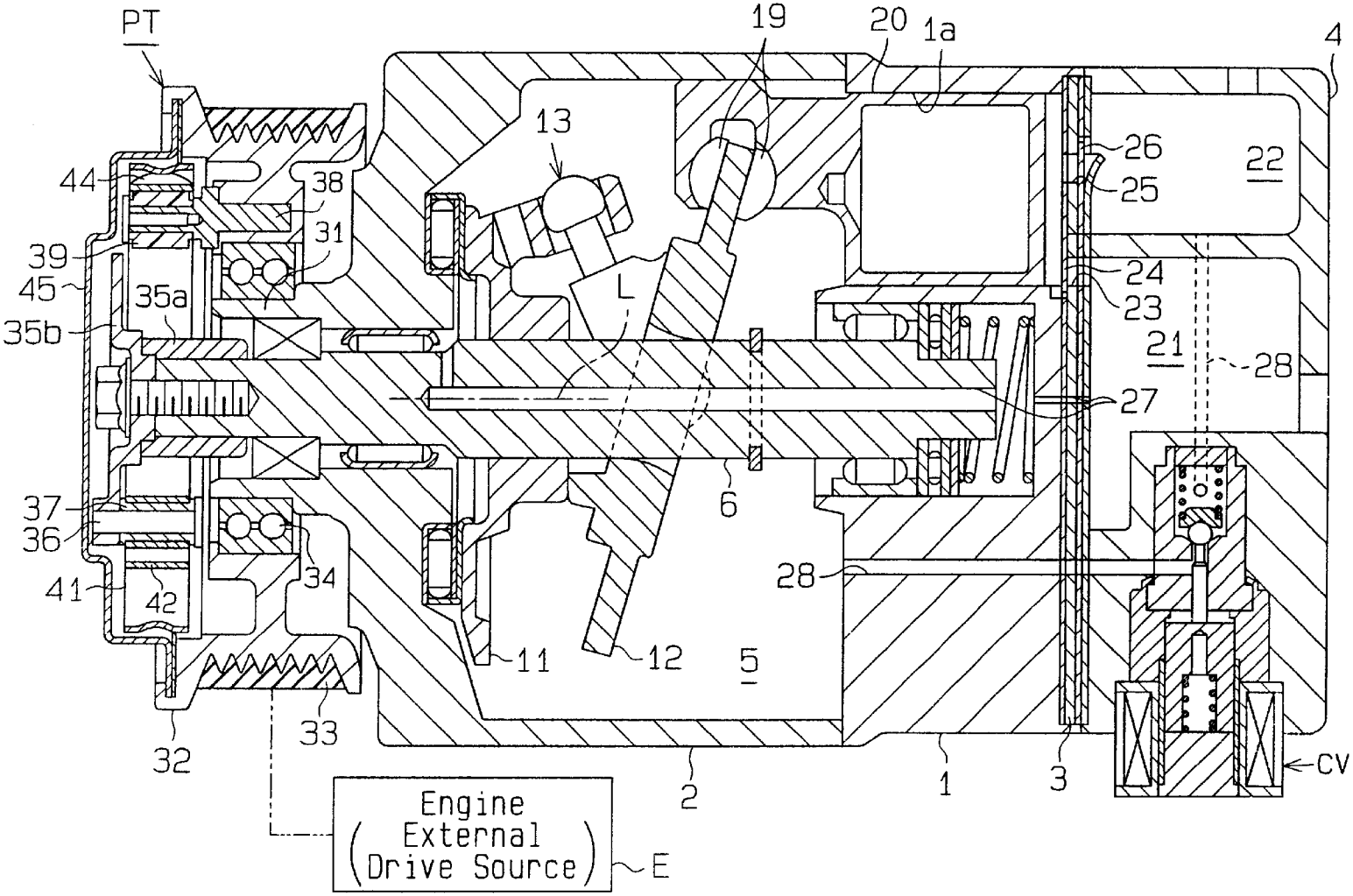
FIG. 1 is a cross-sectional view illustrating a compressor that has a power transmitting mechanism according to a first embodiment of the present invention.

As shown in FIG. 1, the compressor includes a cylinder block 1, a front housing member 2, and a rear housing member 4. The front housing member 2 is secured to the front end of the cylinder block 1. The rear housing member 4 is secured to the rear end of the cylinder block 1. A valve plate 3 is secured between the cylinder block 1 and the rear housing member 4. The cylinder block 1, the front housing member 2, and the rear housing member 4 form the housing assembly of the compressor. In FIG. 1, the left side of the figure is defined as the front, and the right side of the figure is defined as the rear.

A crank chamber 5 is defined between the cylinder block 1 and the front housing member 2. A drive shaft 6 is rotatably supported in the crank chamber 5. A lug plate 11 is located in the crank chamber 5 and is secured to the drive shaft 6 to integrally rotate with the drive shaft 6.

The front end of the drive shaft 6 is coupled to the engine E of a vehicle by means of a power transmitting mechanism PT. In this embodiment, the engine E functions as the external drive source. The power transmitting mechanism PT may be a clutch mechanism (such as an electromagnetic clutch), which selectively transmits and disconnects power by external electrical control. The power transmitting mechanism PT may also be a clutchless type mechanism (such as a combination of a belt and a pulley), which does not have a clutch mechanism and constantly transmits power. The clutchless type power transmitting mechanism PT is employed in the first embodiment. A power transmitting mechanism PT that is used with a clutch will be described in the second embodiment.

A swash plate 12 is accommodated in the crank chamber 5. The swash plate 12 is supported by the drive shaft 6 to slide and to incline. A hinge mechanism 13 is arranged between the lug plate 11 and the swash plate 12. Accordingly, the swash plate 12 rotates integrally with the lug plate 11 and the drive shaft 6 by means of the hinge mechanism 13. The swash plate 12 inclines with respect to the drive shaft 6 while sliding along the axis of the drive shaft 6.

Cylinder bores 1*a* (only one of the cylinder bores is shown in FIG. 1) are formed in the cylinder block 1 to encompass the drive shaft 6. Each cylinder bore 1*a* is formed through the cylinder block 1. A single-headed piston 20 is housed in each cylinder bore 1*a*. The valve plate 3 closes the rear opening of each cylinder bore 1*a* and the piston 20 closes the front opening of each cylinder bore 1*a*. A compression chamber is defined in each cylinder bore 1*a*. The volume of the compression chamber varies as each piston 20 reciprocates in the corresponding cylinder bore 1*a*. Each piston 20 is coupled to the periphery of the swash plate 12 by a pair of shoes 19. Therefore, when the swash plate 12 rotates integrally with the drive shaft 6, rotation of the swash plate 12 reciprocates each piston 20 by means of the pair of shoes 19.

A suction chamber 21 and a discharge chamber 22 are respectively defined between the valve plate 3 and the rear housing member 4. A suction port 23 and a suction valve 24, which selectively opens and closes the port 23, are formed in the valve plate 3 for each cylinder bore 1*a*. A discharge port 25 and a discharge valve 26, which selectively opens and closes the port 25, are formed in the valve plate 3 for each cylinder bore 1*a*. The suction chamber 21 and each cylinder bore 1*a* are connected by the corresponding suction port 23. Each cylinder bore 1*a* and the discharge chamber 22 are connected by the corresponding discharge port 25.

The movement of each piston 20 from the top dead center to the bottom dead center draws refrigerant gas in the suction chamber 21 into the associated cylinder bore 1*a* through the corresponding suction port 23 and the corresponding suction valve 24. The movement of each piston 20 from the bottom dead center to the top dead center compresses the refrigerant gas drawn into the associated cylinder bore 1*a*, to a predetermined pressure. Then, the compressed refrigerant gas is discharged to the discharge chamber 22 through the corresponding discharge port 25 and the corresponding discharge valve 26.

In the above mentioned compressor, the inclination angle of the swash plate 12 is arbitrarily set between the maximum inclination angle (as shown in FIG. 1) and the minimum inclination angle by adjusting the internal pressure of the crank chamber 5 using an electromagnetic control valve CV.

The crank chamber 5 and the suction chamber 21 are connected by a bleed passage 27. The discharge chamber 22 and the crank chamber 5 are connected by a supply passage 28, in which the electromagnetic control valve CV is located. The flow rate of highly pressurized discharge gas that is conducted to the crank chamber 5 from the discharge chamber 22 through the supply passage 28 is set by adjusting the opening degree of the electromagnetic control valve CV using a control apparatus, which is not shown in the figures. The internal pressure of the crank chamber 5 is determined by the relationship between the flow rate of gas entering the crank chamber 5 and the flow rate of gas that is flowing from the crank chamber 5 into the suction chamber 21 through the bleed passage 27. The difference between the internal pressure of the crank chamber 5 and the internal pressure of each cylinder bore 1*a* changes according to the internal pressure of the crank chamber 5. The inclination angle of the swash plate 12 is determined by this pressure difference. As a result, the stroke of each piston 20, or the displacement, is adjusted.

Figure 2:
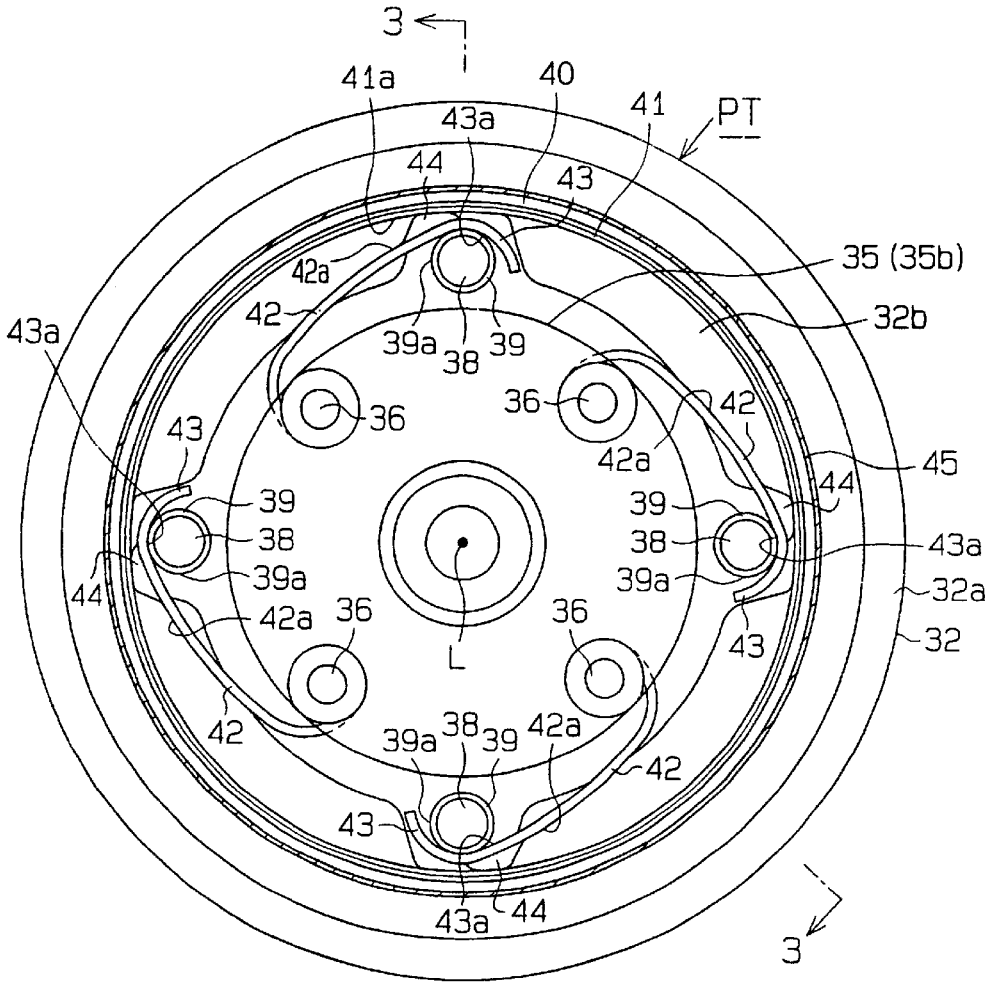
FIG. 2 is a front view illustrating the power transmitting mechanism of FIG. 1 without a cover.
Figure 3:
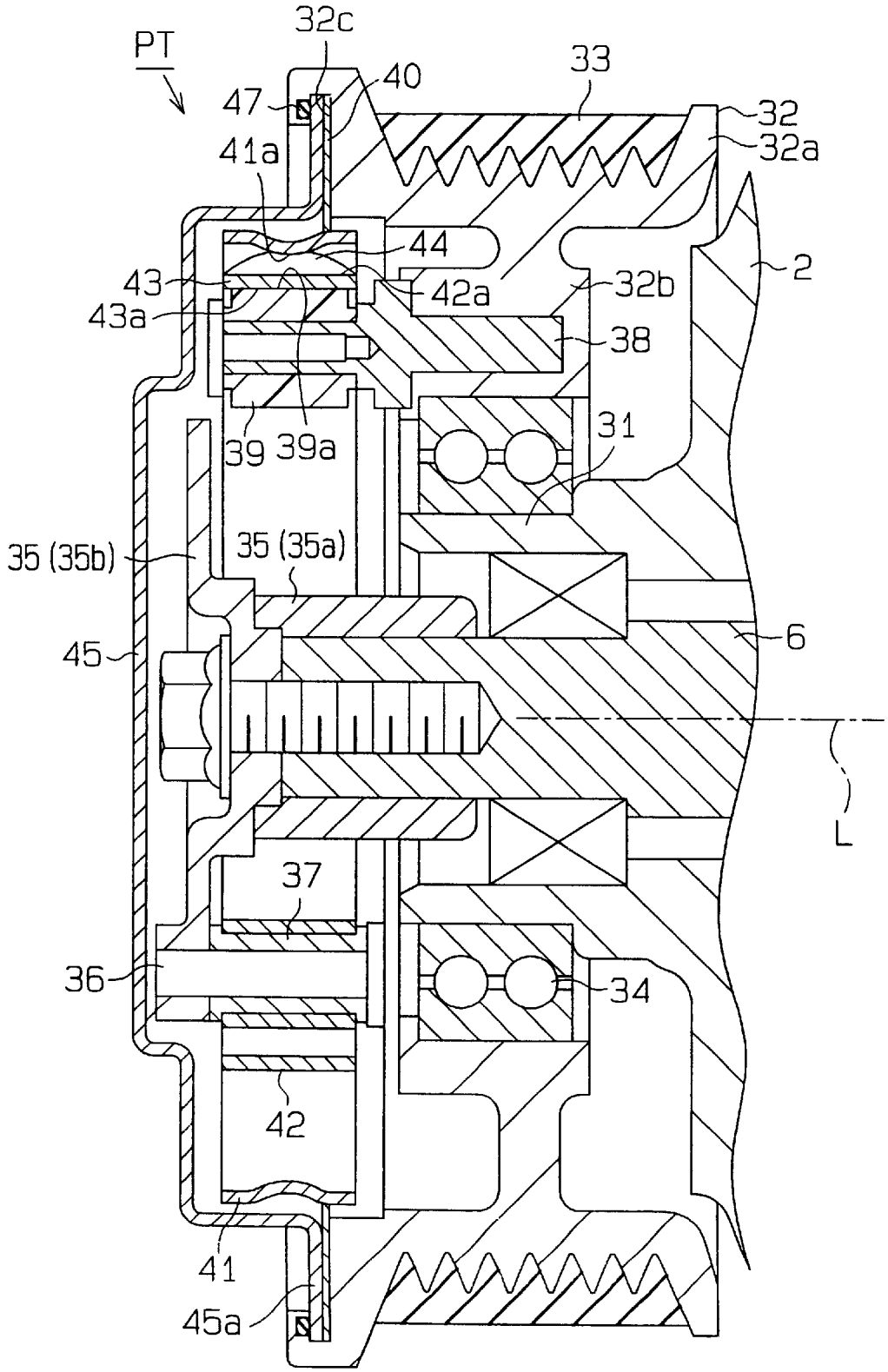
FIG. 3 is a cross-sectional view taken along line 3—3 of FIG. 2.

As shown in FIGS. 2 and 3, the exterior wall of the front housing member 2 protrudes to form a support cylinder that surrounds the front end of the drive shaft 6. A pulley 32, which functions as a first rotor, includes a cylindrical belt engaging member 32*a* and an annular support member 32*b*. A belt 33, which extends from the output axis of the engine E (refer to FIG. 1), is wrapped around the cylindrical belt engaging member 32*a*. The annular support member 32*b* is inward of the inner surface of the belt engaging member 32*a*. The support member 32*b* is rotatably supported by the support cylinder 31 through a bearing 34. The pulley 32 is located around the same axis as the axis L of the drive shaft 6 and rotates relative to the drive shaft 6.

A receiving member 35, which functions as a second rotor, is secured to the front end of the drive shaft 6 to integrally rotate with the drive shaft 6. The receiving member 35 includes a cylindrical member 35*a* and a disc-shaped hub 35*b*. The cylindrical member 35*a* is fitted on the front end of the drive shaft 6. The hub 35*b* is fitted into the front end of the cylindrical member 35*a*.

Support pins 36 (four support pins are used in this embodiment) are secured to the periphery of the hub 35*b* at equal angular intervals (90 degrees in this embodiment) about the axis L. A cylindrical sleeve 37 is fitted on the periphery of each support pin 36 with an appropriate pressure. When a strong rotational force is applied to one of the sleeves 37, it can rotate relative to the corresponding support pin 36.

Engaging pins 38 (four engaging pins are applied in this embodiment) are secured to the front surface of the support member 32*b* of the pulley 32 at equal angular intervals (90 degrees in this embodiment) about the axis L. A cylindrical roller 39 is rotatably supported by each engaging pin 38. The engaging pins 38 are further from the axis L than the support pins 36.

In the pulley 32, an annular fitting groove 32*c* is formed at the front portion of the belt engaging member 32*a*. The periphery of an annular stopper 40, which is a flat ring, is fitted in the fitting groove 32*c*. A cylindrical limit ring 41 is connected to the pulley 32 by the inner edge of the stopper 40. The limit ring 41 is coaxial with the pulley 32 and encompasses the rollers 39. The middle section of the inner surface of the limit ring 41 bulges inwardly, as shown, and forms a limit surface 41*a*.

A power transmission arm 42 is formed by a leaf spring and is located between each sleeve 37 and one of the rollers 39. The proximal end of each power transmission arm 42 is securely wound around the sleeve 37 of the corresponding support pin 36. Each power transmission arm 42 extends from the corresponding sleeve 37 toward the corresponding roller 39 in a clockwise direction as viewed from the perspective of FIG. 2. Each power transmission arm 42 is slightly arched toward the periphery of the pulley 32 as shown.

The distal end of each power transmission arm 42 is between the corresponding roller 39 and the limit surface 41*a* of the limit ring 41. In other words, the distal end of each power transmission arm 42 is closer to the periphery of the pulley 32 than the corresponding roller 39. The distal end of each power transmission arm 42 curves inwardly as shown in FIG. 2. Therefore, a curved end 43, which is hooked around the corresponding roller 39, is formed at the distal end of each power transmission arm 42. In other words, each power transmission arm 42 of the receiving member 35 is engaged with the corresponding roller 39 by the curved end 43. The receiving member 35 and the pulley 32 are connected with each other by the arms 42 to transmit power and to rotate relative to one another within a predetermined angular range while transmitting power.

According to this embodiment, each roller 39 and the corresponding curved end 43 are located about the axis L of the rotors 32, 35. Each roller 39 is radially inward of the corresponding curved end 43. Each power transmission arm 42 is supported by the receiving member 35 and the corresponding support pin 36. The support pins 36 are closer to the axis L than the corresponding curved ends 43.

A fulcrum portion 44 is formed on a back surface 42*a* of each power transmission arm 42 to oppose the limit surface 41*a* of the limit ring 41. The fulcrum portions are formed by, for example, attaching a piece of vulcanized rubber to each arm 42. Each fulcrum portion 44 is compressed between the back surface 42*a* of the corresponding power transmission arm 42 and the limit surface 41*a* of the limit ring 41. Each power transmission arm 42 is pressed against the corresponding roller 39 by the repulsive force of the corresponding fulcrum portion 44. In this state, the cylindrical surface 39*a* of each roller 39 is pressed against a concave surface 43*a* of the corresponding curved end 43 of each power transmission arm 42. The radius of curvature of the cylindrical surface 39*a* of each roller 39 is less than the radius of curvature of the concave surface 43*a* inside the corresponding curved end 43, thus linear contact occurs between each cylindrical surface 39*a* and the corresponding concave surface 43*a*.

The concave surface 43*a* of each curved end 43 is curved. Thus, the inclination of a tangent to the curve of each arm increases at the distal and proximal ends. In the state shown in FIG. 2, the contact point between the cylindrical surface 39*a* of each roller 39 and the concave surface 43*a* of the corresponding curved end 43 moves toward the distal end or toward the proximal end of the corresponding power transmission arm 42 when one of the rollers 39 and the corresponding power transmission arm 42 move relative to one another. As a result, each roller 39 applies force to the corresponding power transmission arm 42 in an outward direction when the pulley 32 is driven.

A cover 45 has a cylindrical shape with a closed end. A flange 45*a,* which is formed at the periphery of the cover 45, is fitted in the fitting groove 32*c* together with the outer edge of the stopper 40. The cover 45 is used to cover the front end of the pulley 32. Each member that transmits power between the pulley 32 and the drive shaft 6 (receiving member 35, support pins 36, engaging pins 38, rollers 39, limit ring 41, and power transmission arms 42) is accommodated in the space between the cover 45 and the pulley 32. An annular sealing member 47 is fitted in the fitting groove 32*c* along a side wall surface. The sealing member 47 contacts the flange 45*a* of the cover 45 to seal the space between the cover 45 and the pulley 32.

Operation of the Power transmitting mechanism

The engine E transmits power to the pulley 32 via the belt 33. The power is then transmitted to the receiving member 35 by the rollers 39 and the power transmission arms 42. The power is then transmitted to the drive shaft 6 of the compressor. Load torque is generated between the receiving member 35 of the compressor and the pulley 32 of the engine E during power transmission. The load torque causes each roller 39 and the corresponding power transmission arm 42 to move relative to one another, which causes the pulley 32 and the receiving member 35 to rotate relative to one another.

Figure 4:
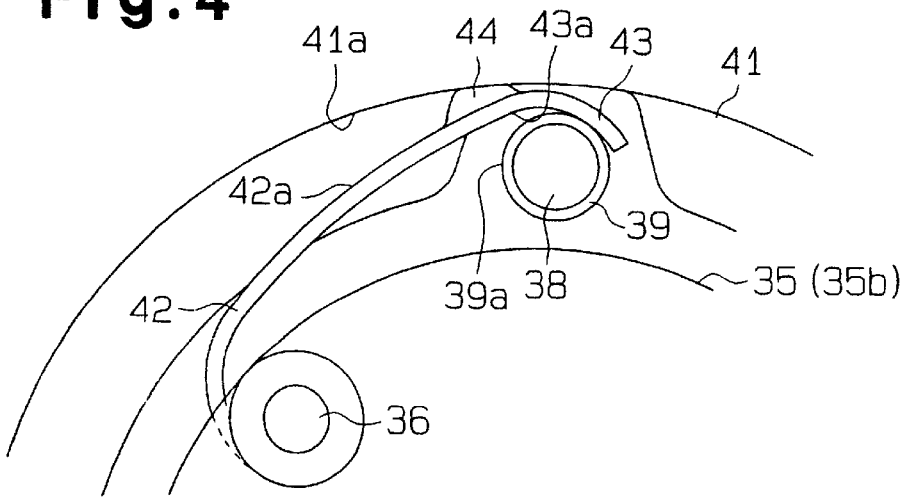
FIG. 4 is a diagram explaining the operation of the power transmitting mechanism of FIG. 1.

As shown in FIG. 4, when the pulley 32 rotates clockwise, the load torque tends to rotate the receiving member 35 counter-clockwise with respect to the pulley 32. Therefore, each roller 39 and the corresponding power transmission arm 42 tend to move relative to one another. The contact points between them move toward the distal ends of the power transmission arms 42. The location where the fulcrum portion 44 presses against the limit surface 41*a* of the limit ring 41 functions as a fulcrum. Then, the distal end of the power transmission arm 42 is elastically deformed generally outward. That is, the power transmission arm 42 is elastically deformed based on the load torque. Thus, the curved end 43 changes attitude with respect to the receiving member 35, in other words, the concave surface 43*a* is deformed.

When the displacement of the compressor increases and the load torque is increased, the force that elastically deforms the distal end of each power transmission arm 42 generally outward is increased. Therefore, each roller 39 further elastically deforms the corresponding power transmission arm 42 and relatively moves to the distal end of the corresponding power transmission arm 42. As a result, each roller 39 rotates along the corresponding concave surface 43*a* and the contact point further moves toward the distal end of the corresponding power transmission arm 42. Accordingly, the relative rotation angle between the pulley 32 and the receiving member 35 is increased.

However, when the displacement of the compressor decreases and the load torque is decreased, the force that elastically deforms the distal end of each power transmission arm 42 generally outward is decreased. Therefore, some of the energy that is accumulated in each power transmission arm 42 is released and the roller 39 relatively move to the proximal ends of the corresponding power transmission arms 42. As a result, each roller 39 rotates along the concave surface 43*a* and the contact point moves to the proximal end of the corresponding power transmission arm 42. Accordingly, the relative rotation angle of the pulley 32 and the receiving member 35 is decreased.

When the compressor is actually driven by the engine E, the output torque of the engine E or the driving torque of the auxiliary equipment, for example, a hydraulic pump of a power steering apparatus, fluctuates. Thus, the power that is transmitted from the pulley 32 to the receiving member 35 varies. In this case, the position of the contact point is changed repeatedly. In other words, the pulley 32 repeats relative rotation in the clockwise and counter-clockwise direction within the predetermined angular range. Thus, the fluctuation of power that is transmitted from the pulley 32 to the receiving member 35 is suppressed.

When the amount of the load torque does not adversely affect the engine E, that is, when the load torque is smaller than the maximum allowable torque, the contact point is kept on the concave surface 43*a*. In other words, each roller 39 and the corresponding curved end 43 are kept engaged and the power transmission from the engine E to the drive shaft 6 is continued.

Figure 5:
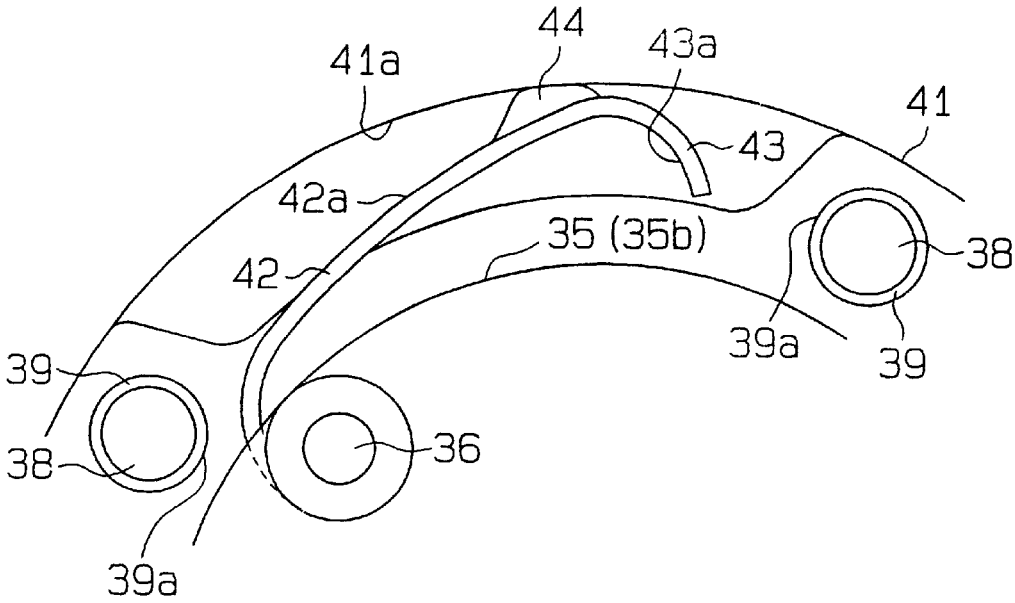
FIG. 5 is a diagram explaining the torque limit operation of the power transmitting mechanism of FIG. 1.

However, as shown in FIG. 5, when an abnormality occurs in the compressor, or when the compressor is locked, the load torque becomes equal to or greater than the maximum torque. In this case, the stiffness of each power transmission arm 42 is insufficient to keep the contact point on the concave surface 43*a*. Accordingly, the roller 39 moves beyond the curved end 43 to the distal end of the power transmission arm 42 and separates from the concave surface 43*a*. Thus, each roller 39 and the corresponding power transmission arm 42 are disengaged. Therefore, the power transmission between the pulley 32 and the receiving member 35 is disconnected. This prevents the engine E from being affected by excessive load torque.

Figure 6:
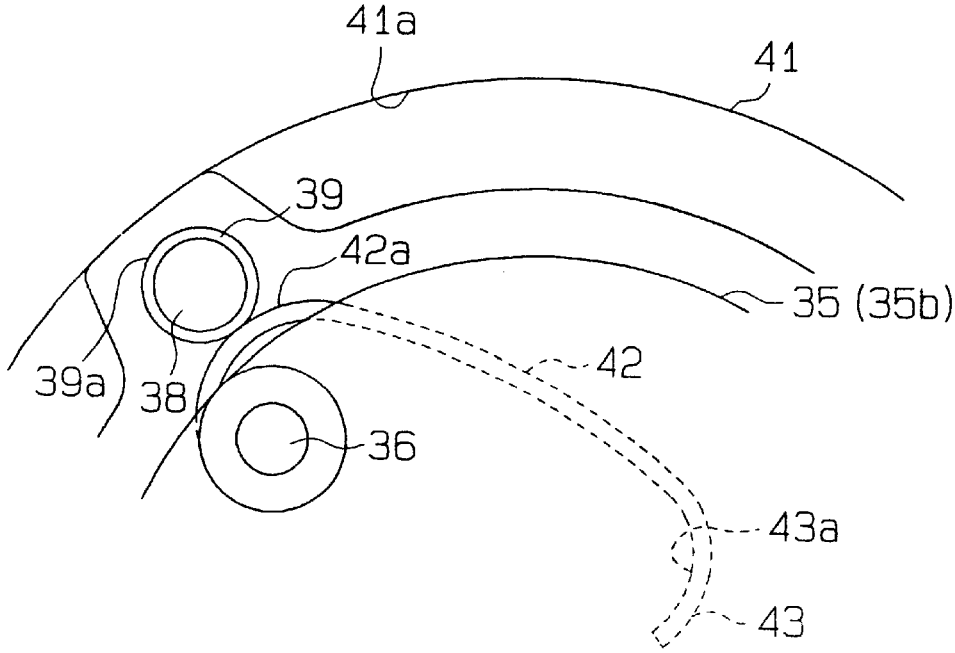
FIG. 6 is a diagram explaining the torque limit operation of the power transmitting mechanism of FIG. 1.
Figure 7:
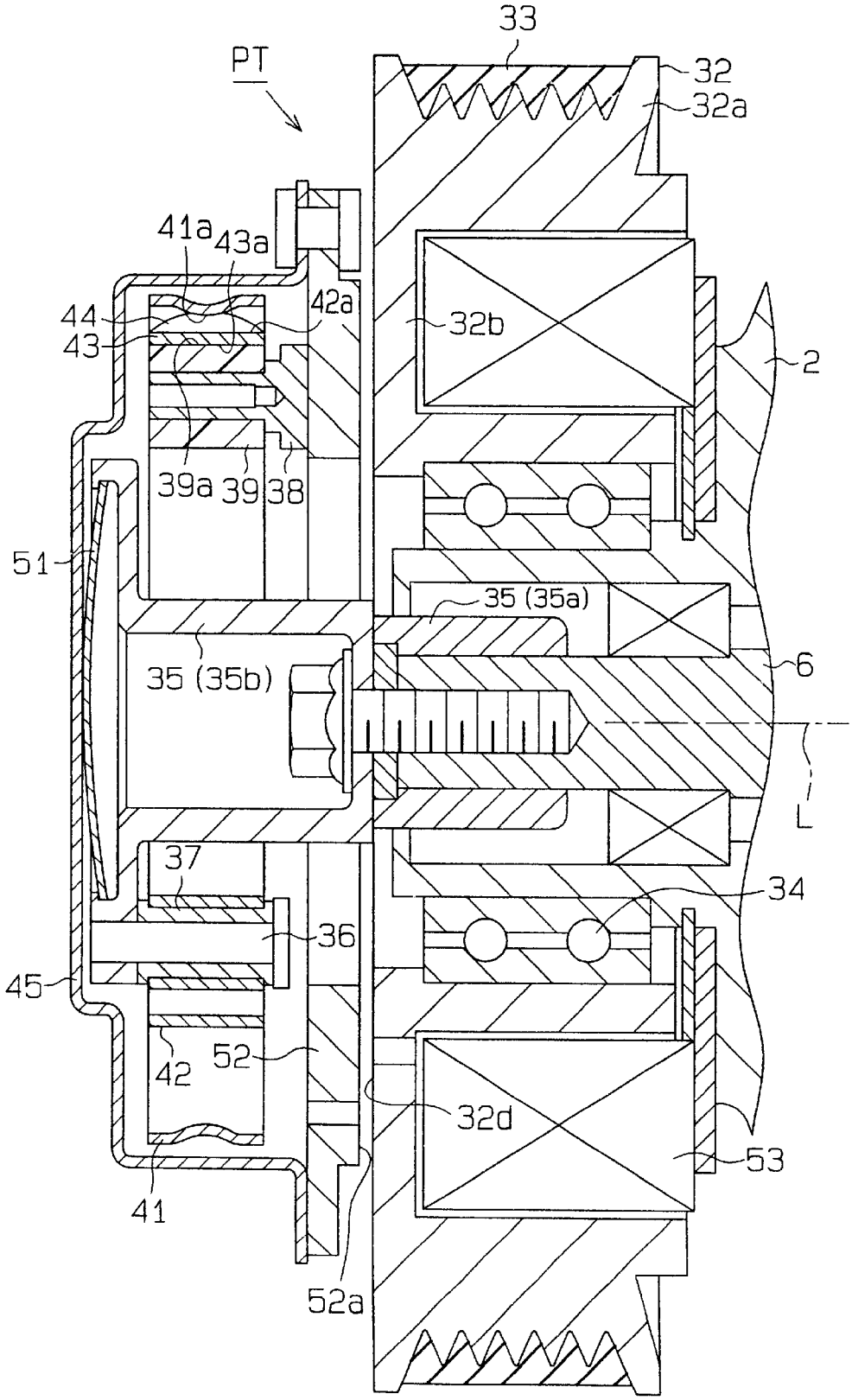
FIG. 7 is a cross-sectional view illustrating the power transmitting mechanism according to a second embodiment of the present invention.

After each roller 39 and the corresponding power transmission arm 42 are disengaged, a next roller 39 on the pulley 32 contacts the back surface 42*a* of the corresponding power transmission arm 42 due to the free relative rotation of the pulley 32 with respect to the receiving member 35. This rotates the corresponding power transmission arm 42 about the corresponding support pin 36, as shown in FIG. 6. As a result, the corresponding power transmission arms 42 are rotated clockwise with the respective sleeves 37 about the respective support pins 36. Thus, the power transmission arms 42 change position with respect to the receiving member 35.

The curved end 43 of each power transmission arm 42 is closer to the periphery of the pulley 32 than the roller 39 just after the arm 42 comes off the roller 39. However, the curved end 43 of each power transmission arm 42 is moved closer to the center of the pulley 32 than the roller 39 after the pulley rotates by a quarter revolution, or in other words, after each roller 39 contacts the corresponding power transmission arm 42 at the back surface 42*a*. Each support pin 36 is inserted in the corresponding sleeve 37 with an appropriate pressure. Thus, even if an external force is applied, for example, by the vehicle vibration, the power transmission arms 42 reliably keeps the rollers 39 from being engaged (as shown in FIG. 6). Accordingly, the rollers 39 do not interfere with the power transmission arms 42 (or curved ends 43). Thus, power transmission between the pulley 32 and the receiving member 35 is reliably disconnected. Interference between the roller 39 and the power transmission arms 42, which would apply load against the engine E and would cause a loss of engine power, is prevented. This structure prevents the roller 39 and the power transmission arm 42 from hitting each other repeatedly and thus causing noise and vibration.

This embodiment provides the following advantages.

The invention minimizes the loss of fuel efficiency by reliably discontinuing power transmission between the pulley 32 and the receiving member 35 when the load torque between the pulley 32 and the receiving member 35 is excessive.

The position of each power transmission arm 42 is changed by rotating it about the corresponding support pin 36 when the curved ends 43 and the corresponding rollers 39 are disengaged. Therefore, compared with a structure that changes the position of the power transmission arm 42 by deformation, the change of position is performed more smoothly.

The rollers 39 and the engine E are used for changing the position of the power transmission arms 42. Accordingly, no special member, such as springs, is required for changing the position of the power transmission arms 42. Thus, the structure of the power transmitting mechanism is simplified.

The cylindrical surface 39*a* of each roller 39 rolls along the concave surface 43*a* of the corresponding curved end 43 repeatedly against the friction between the cylindrical surface 39*a* and the concave surface 43*a*. This reduces torque shock applied to the engine.

Each roller 39 rotates while sliding along the concave surface 43*a* of the corresponding curved end 43. Compared with an engaging pin 38, which does not rotate while directly contacting the concave surface 43*a* of the corresponding curved end 43 (such an engaging pin is also within the concept of the present invention), the likelihood of a malfunction in slidability is reduced. Thus, fluctuation of power transmission is effectively suppressed.

Compared with a concave surface 43*a* that is formed by a combination of planar surfaces with different inclination angles (such a concave surface is also within the concept of the present invention), each roller 39 smoothly rolls on the corresponding concave surface 43*a*. This permits smooth relative rotation between the pulley 32 and the receiving member 35. Thus, smooth power transmission is achieved, and fluctuation of power transmission is effectively suppressed.

Each curved end 43 is connected to the hub 35*b* by means of the corresponding power transmission arm 42, which functions as an elastic member. Thus, each curved end 43 changes position with respect to the hub 35*b* by elastic deformation of the corresponding power transmission arm 42. In other words, the elastic arms 42 add elasticity to the transmission apparatus. Compared with a case, for example, where separate elastic members are provided in addition to the coupler, the number of power transmission members are reduced.

The position of the contact point changes along the concave surface 43*a* repeatedly when the transmitted power varies. Accordingly, the distance between the contact point and the fulcrum of the deformation of the corresponding power transmission arm 42 (contact point between each fulcrum portion 44 and the limit ring 41) changes. The modulus of elasticity of the power transmission arm 42 and resonance frequency constantly change accordingly. Thus, the mechanism prevents the resonance from being generated by the vibration of the relative rotation, which is based on the variation of the transmitted power, of the pulley 32 and the receiving member 35.

Each power transmission arm 42 is formed by a leaf spring. Each curved end 43 is formed by curving the corresponding power transmission arm 42. Therefore, the curved ends 43 are easily formed.

Each power transmission arm 42 elastically deforms in the radial direction of the pulley 32 (each curved end 43 changes shape) when the torque is transmitted. Each power transmission arm 42 also rotates to position inwardly in the radial direction of the pulley 32 when the torque transmission is disconnected. Therefore, no space is required in the direction of the axis L for deformation and rotation of each power transmission arm 42. Thus, the size of the power transmitting mechanism PT, more specifically, the size of the compressor, which has the power transmitting mechanism PT, is miniaturized in the direction of axis L. The space allotted for the compressor in an engine compartment of a vehicle is limited. For an air-conditioning compressor in a vehicle, miniaturization in the direction of the axis L is preferred over miniaturization in the radial direction. Accordingly, the power transmitting mechanism PT in the first embodiment has a suitable structure for a compressor of a vehicle air-conditioning system. The elastic deformation of each power transmission arm 42 does not generate the reaction force in the direction of axis L of the drive shaft 6. Thus, the mechanism prevents force from acting on the compressor in the direction of axis L, which adversely affects the compressor.

The pulley 32 includes the cover 45. Each member that transmits power (such as the receiving member 35, the support pins 36, the engaging pins 38, the rollers 39, the limit ring 41, and the power transmission arms 42) is accommodated in the space between the cover 45 and the pulley 32. This structure prevents foreign objects and water, oil, or dust in the engine compartment of a vehicle from affecting the transmission parts. Thus, wear resulting from the contamination of the members is eliminated. The structure also prevents foreign objects from being caught between the cylindrical surface 39*a* of each roller 39 and the concave surface 43*a* of the corresponding curved end 43. Accordingly, smooth rotation of the rollers 39 is maintained.

Second Embodiment

In the second embodiment, only the parts different from the first embodiment are explained. Like members are given like numbers and detailed explanations are omitted.

In the second embodiment, a pulley 32 has an electromagnetic clutch, which selectively transmits and disconnects power by external electrical control, as shown in FIG.

7. A cover 45 is supported by a hub 35*b* of a receiving member 35. A leaf spring 51 is located between the cover 45 and the hub 35*b*. An armature 52 is secured to the cover 45 and is located between the pulley 32 and a limit ring 41. Engaging pins 38 are secured to the armature 52. The limit ring 41 is not engaged with the pulley 32 and is fitted on the power transmission arm 42. A core 53 is located at the rear of the pulley 32 in the front housing member 2.

When the core 53 is excited by the externally applied power, the armature 52 and the cover 45 is drawn towards the pulley 32 with the rollers 39 against the leaf spring 51. Therefore, a clutch surface 52*a* of the armature 52 is pressed against a clutch surface 32*d* of the pulley 32. Thus, power is transmitted between the pulley 32 and the engaging pin 38 (or the roller 39).

In this state, when the core 53 is demagnetized by stopping the current supply, the force of the leaf spring 51 urges the armature 52 and the cover 45 with the roller 39 away from the pulley. Therefore, the clutch surface 32*d* and 52*a* are separated, thus, power transmission between the pulley 32 and the engaging pin 38 is disconnected.

In the second embodiment, for example, a compressor may be stopped by an external control when air-conditioning is not required. Thus, loss of power of an engine E is reduced.

It should be apparent to those skilled in the art that the present invention may be embodied in many other specific forms without departing from the spirit or scope of the invention. Particularly, it should be understood that the invention may be embodied in the following forms.

Elasticity need not be provided in the power transmission path. That is, the power transmission arms 42 may be rigid bodies in the above embodiments. Instead, the limit ring 41 may be formed of an elastic material, which elastically deforms to radially expand and contract. Thus, each power transmission arm 42 (curved end 43) rotates about the corresponding support pin 36 according to the load torque when the roller 39 and the curved end 43 are engaged. As a result, each curved end 43 changes position with respect to the receiving member 35.

The engaging pins 38 may be closer to the axis L than the pins 36.

In the illustrated embodiments, four pairs of rollers 39 and power transmission arms 42 are provided. The number of pairs is not limited to four, but may be six, five, three, two, or one. If the number of the pairs is reduced, the assembly of the power transmitting mechanism is simplified and the cost is reduced. If the number of the pairs is increased, the amount of transmission torque transmitted by each pair is reduced. Thus the endurance of each roller 39 and the corresponding power transmission arm 42 is improved. In other words, the endurance of the power transmitting mechanism PT is improved.

A part of the back surface 42*a* of each power transmission arm 42 may be deformed to integrally form the fulcrum portion 44.

Balls may be used instead of rollers 39 as a rotating element.

The rollers may be arranged to change position with respect to the rotor on which the rollers are located, instead of the curved ends. For example, the curved ends 43 may be fixed instead of the engaging pins 38. The rollers 39 may be provided on the distal ends of the power transmission arms 42 to engage with the corresponding curved ends 43.

Both curved ends 43 and the rollers 39 may be arranged to change position with respect to the rotors 32 and 35, respectively.

A spring, which urges each power transmission arm 42 radially inward, may be provided between each power transmission arm 42 and the corresponding receiving member 35. Each spring changes the position of the corresponding power transmission arm 42. Each spring may be arranged to pull the corresponding power transmission arm 42 toward the drive shaft 6. Each spring may also be provided between one of the support pins 36 and the corresponding sleeve 37 to rotate the sleeve 37. In this case, when the rollers 39 and the corresponding power transmission arms 42 are disengaged, the power transmission arms 42 rotate to the withdrawn position without contacting the rollers 39. That is, the corresponding power transmission arms 42 change position with respect to the receiving member 35. This reliably prevents noise and vibration caused by collision of the arms 42 and the rollers 39.

The second embodiment may be modified to include an electromagnetic clutch structure between the receiving member 35 and the drive shaft 6.

The use of the torque transmitting mechanism of the above embodiments is not limited to power transmission between an engine E and an air-conditioning compressor. The mechanism may be used for power transmission between an engine E and any auxiliary device (such as a hydraulic pump for a power steering apparatus or a cooling fan for a radiator). The application of the power transmitting mechanism of the above embodiments is not limited to a power transmission path of a vehicle. The mechanism may be used for a power transmission path between a drive source and in a machine tool. The power transmitting mechanism of the above embodiments has general versatility and may be applied to any power transmission path.

Therefore, the present examples and embodiments are to be considered as illustrative and not restrictive and the invention is not to be limited to the details given herein, but may be modified within the scope and equivalence of the appended claims.

What is claimed is:

1. A power transmitting mechanism comprising:

a first rotor;

a second rotor, which is coaxial to the first rotor and is driven by the first rotor;

a coupler for connecting the first rotor to the second rotor such that the coupler uncouples when the torque transmitted by the coupler exceeds a predetermined value, wherein the coupler includes a first coupling member, which is formed on the first rotor, and a second coupling member, which is formed on the second rotor, wherein one of the coupling members includes an arm, a distal end of which engages the other of the coupling members, wherein when the arm is disengaged from the other of the coupling members, the distal end moves in a generally radial direction of the rotors to be kept in a non-interfering position as a result of contact between the arm and the other of the coupling members.

2. The power transmitting mechanism of claim 1, wherein relative rotation between the first and second rotors causes the arm to be rotated such that the distal end moves in a generally radial direction of the rotor.

3. The power transmitting mechanism according to claim 1, wherein the first coupling member and the second coupling member are offset from each other in a radial direction of the rotors, and the arm is supported at a predetermined position of one of the two rotors, wherein the predetermined position is offset in the radial direction from the other of the coupling members, and wherein, when the coupler is coupled, the distal end of the arm is located generally on a first side of the other coupling member and when the coupler is uncoupled, the distal end is located on a second side of the other coupling member, wherein the first side is generally opposite to the second side.

4. The power transmitting mechanism of claim 1, wherein the second coupling member includes the arm, and the second rotor is located inside the first rotor, and the first rotor includes a roller, the axis of which extends in the axial direction of the rotors, such that, when the coupler uncouples during rotation of the rotors, the roller contacts the arm and rotates the arm such that the distal end moves in the generally radial direction.

5. The power transmitting mechanism of claim 1, further comprising a cover, wherein the cover covers the coupling members.

6. The power transmitting mechanism of claim 1, wherein the second coupling member includes the arm.

7. The power transmitting mechanism of claim 6, wherein the first coupling member includes a roller and the arm includes a concave surface that engages the roller.

8. The power transmitting mechanism of claim 7, wherein the concave surface elastically deforms when torque between the rotors causes the coupler to apply force to the arm, and the coupler permits the rotors to rotate relative to one another for a predetermined angular range.

9. The power transmitting mechanism of claim 6, wherein the roller rolls along the concave surface in response to torque variation between the rotors.

10. The power transmitting mechanism of claim 6, wherein the arm has a modulus of elasticity that varies according to a relative position between the rotors when the coupler is coupled.

11. The power transmitting mechanism of claim 6, wherein the distal end is deformed in a generally radial direction of the rotors.

12. The power transmitting mechanism of claim 6, wherein the arm is elastic.

13. The power transmitting mechanism of claim 6, further comprising a clutch that is externally controlled to selectively transmit power between the first and second rotors.

14. A power transmitting mechanism for transmitting power from an external drive source to a drive shaft of a compressor, comprising:

a pulley;

a hub connected to the drive shaft, which is coaxial to the pulley and is driven by the pulley;

a coupler for connecting the pulley to the hub such that the coupler uncouples when the torque transmitted by the coupler exceeds a predetermined value, wherein the coupler includes a first coupling member, which is formed on the pulley, and a second coupling member, which is formed on the hub, wherein one of the coupling members includes an arm, a distal end of which engages the other of the coupling members, wherein when the arm is disengaged from the other of the coupling members, the distal end moves in a generally radial direction of the rotors to be kept in a non-interfering position as a result of contact between the arm and the other of the coupling members.

15. The power transmitting mechanism of claim 14, wherein relative rotation between the pulley and the hub causes the arm to be rotated such that the distal end moves in a generally radial direction of the pulley and the hub.

16. The power transmitting mechanism according to claim 14, wherein the first coupling member and the second coupling member are offset from each other in a radial direction of the pulley and the hub, and the arm is supported at a predetermined position of one of the pulley and the hub, wherein the predetermined position is offset in the radial direction from the other of the coupling members, and wherein, when the coupler is coupled, the distal end of the arm is located generally on a first side of the other coupling member and when the coupler is uncoupled, the distal end is located on a second side at the other coupling member, wherein the first side is generally opposite to the second side.

17. The power transmitting mechanism of claim 14, wherein the second coupling member includes the arm, and the hub is located inside the pulley, and the pulley includes a roller, the axis of which extends in the axial direction of the pulley and the hub, such that, when the coupler uncouples during rotation of the pulley and the hub, the roller contacts the arm and rotates the arm such that the distal end moves in the generally radial direction.

18. The power transmitting mechanism of claim 14, wherein the second coupling member includes the arm.

19. The power transmitting mechanism of claim 18, wherein the first coupling member includes a roller and the arm includes a concave surface that engages the roller.

20. The power transmitting mechanism of claim 19, wherein the concave surface elastically deforms when torque between the pulley and the hub causes the coupler to apply force to the arm, and the coupler permits the pulley and the hub to rotate relative to one another for a predetermined angular range.

21. The power transmitting mechanism of claim 20, wherein the roller rolls along the concave surface in response to torque variation between the pulley and the hub.

22. The power transmitting mechanism of claim 20, wherein the arm has a modulus of elasticity that varies according to a relative position between the pulley and the hub when the coupler is coupled.

23. A power transmitting mechanism comprising:

a first rotor;

a second rotor, which is coaxial to the first rotor and is driven by the first rotor;

a coupler for connecting the first rotor to the second rotor such that the coupler uncouples when the torque transmitted by the coupler exceeds a predetermined value, wherein the coupler includes a first coupling member, which is formed on the first rotor, and a second coupling member, which is formed on the second rotor, wherein one of the coupling members includes an arm, a distal end of which engages the other of the coupling members, wherein the arm is disengaged from the other of the coupling members and the distal end moves in a generally radial direction of the rotors to a non interfering position when the coupler uncouples, wherein the second coupling member includes the arm and wherein the first coupling member includes a roller and the arm includes a concave surface that engages the roller.

* * * * *